US011809110B2

(12) United States Patent
Maenishi et al.

(10) Patent No.: US 11,809,110 B2
(45) Date of Patent: Nov. 7, 2023

(54) IMAGE FORMING APPARATUS

(71) Applicant: KYOCERA Document Solutions Inc., Osaka (JP)

(72) Inventors: Junta Maenishi, Osaka (JP); Fumito Nakamoto, Osaka (JP); Hirotaka Ishida, Osaka (JP); Son Rai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/752,822

(22) Filed: May 24, 2022

(65) Prior Publication Data

US 2022/0413418 A1 Dec. 29, 2022

(30) Foreign Application Priority Data

Jun. 29, 2021 (JP) ..... 2021-107246

(51) Int. Cl.
*G03G 15/20* (2006.01)

(52) U.S. Cl.
CPC ..... *G03G 15/2053* (2013.01)

(58) Field of Classification Search
CPC ..... G03G 15/205; G03G 15/2017; G03G 15/2028; G03G 15/2039; G03G 15/2053; G03G 2215/2045; G03G 2215/00603
See application file for complete search history.

(56) References Cited

U.S. PATENT DOCUMENTS

2016/0116875 A1* 4/2016 Hazeyama ..... G03G 15/2028 399/67
2018/0329353 A1* 11/2018 Murasaki ..... F16H 55/18
2021/0191296 A1* 6/2021 Mizuno ..... G03G 15/2032
2021/0191302 A1* 6/2021 Mizuno ..... G03G 15/2064

FOREIGN PATENT DOCUMENTS

JP 2007212583 A 8/2007

* cited by examiner

*Primary Examiner* — Thomas S Giampaolo, II
(74) *Attorney, Agent, or Firm* — Alleman Hall Creasman & Tuttle LLP

(57) ABSTRACT

A fixing member is supported so as to be displaceable in a crossing direction that crosses a sheet conveying direction. A pressure member rotationally drives the fixing member by being rotationally driven. A motor rotationally drives the pressure member. A biasing mechanism elastically biases the fixing member toward the pressure member. A sheet detection portion detects a sheet at a first position and a second position. The first position is a position between a mechanism that feeds the sheet to a fixing position and the fixing position in the conveyance path. The second position is a position between the fixing position and a mechanism that takes over conveyance of the sheet from the fixing device. A control device times a time required for detection results from the sheet detection portion to show a predetermined change, and controls a rotational speed of the motor according to the timed time.

4 Claims, 3 Drawing Sheets

IMAGE FORMING APPARATUS

INCORPORATION BY REFERENCE

This application is based upon and claims the benefit of priority from the corresponding Japanese Patent Application No. 2021-107246 filed on Jun. 29, 2021, the entire contents of which are incorporated herein by reference.

BACKGROUND

The present disclosure relates to an image forming apparatus capable of changing a conveying speed at which a sheet is conveyed by a fixing device.

An electrophotographic-type image forming apparatus includes an image forming device, a transfer device and a fixing device. The image forming device forms a developer image on an image-carrying member. The transfer device transfers the developer image from the image-carrying member to a sheet.

The fixing device fixes the developer image on the sheet by heating and applying pressure to the developer image on the sheet.

The fixing device includes a heater, a fixing member, a pressure member and a biasing mechanism. The fixing member is heated by the heater. The biasing mechanism elastically biases one of either the fixing member or the pressure member in a direction toward the other.

The pressure member has an elastic outer layer that is pressed against the fixing member. A portion where the fixing member and the pressure member come in contact with each other forms a nip portion through which the sheet passes.

In the fixing device, the pressure member may be rotationally driven by the biasing mechanism biasing the fixing member in a direction toward the pressure member, and the pressure member may be rotationally driven. In this case, depending on the extent of thermal expansion of the pressure member, the circumferential speed of the fixing member and the pressure member in the nip portion changes. As a result, the conveying speed at which the sheet is conveyed by the fixing device changes.

In a case where the conveying speed at which the sheet is conveyed by the fixing device is greatly different from the conveying speed at which the sheet is conveyed by conveying mechanisms before and after the fixing device, problems such as poor transfer of the developer to the sheet or damage to the sheet may occur.

In addition, it is known that in the image forming apparatus a bending detection portion detects bending of the sheet between a transfer position and a fixing position in a conveyance path. In this case, the conveying speed at which the sheet is conveyed by the fixing device is switched according to a detection result by the bending detection portion.

SUMMARY

The image forming apparatus according to one aspect of the present disclosure includes a transfer device, a fixing device, a sheet detection portion, and a control device. The transfer device transfers a developer image to a sheet at a transfer position in a conveyance path while conveying the sheet, The fixing device fixes the developer image to the sheet by heating and applying pressure to the developer image on the sheet at a fixing position in the conveyance path while conveying the sheet. The sheet detection portion detects the sheet at a predetermined position in the conveyance path. The control device controls the fixing device. The fixing device includes a heater, a fixing member, a pressure member, a motor, and a biasing mechanism. The fixing member is heated by the heater and supported so as to be able to rotate and so as to be displaceable in a crossing direction that crosses the sheet conveying direction. The pressure member is arranged facing the fixing member in the crossing direction and has an elastic outer layer that comes in pressure contact with the fixing member, and is configured to rotationally drive the fixing member by being rotationally driven. The motor rotationally drives the pressure member. The biasing mechanism elastically biases the fixing member toward the pressure member along the crossing direction. The sheet detection portion detects the sheet at a first position or a second position. The first position is a position between a mechanism that feeds the sheet to the fixing position and the fixing position in the conveyance path. The second position is a position between the fixing position and a mechanism that takes over conveyance of the sheet from the fixing device. The control device includes a timekeeping portion and a speed control portion. The timekeeping portion times a time required for detection results from the sheet detection portion to show a predetermined change. The speed control portion controls the rotational speed of the motor according to the time timed by the timekeeping portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Embodiments according to the present disclosure will be described below with reference to the drawings. Note that the following embodiments are examples of implementing the technique according to the present disclosure and do not limit the technical scope of the present disclosure.

[Configuration of Image Forming Apparatus 10]

An image forming apparatus 10 according to an embodiment includes a printing device 4 that performs a printing process for forming an image on a sheet 9.

The printing device 4 performs the printing process using an electrophotographic method. The sheet 9 is an image-forming medium such as paper or a sheet-like resin material.

Figure 1:
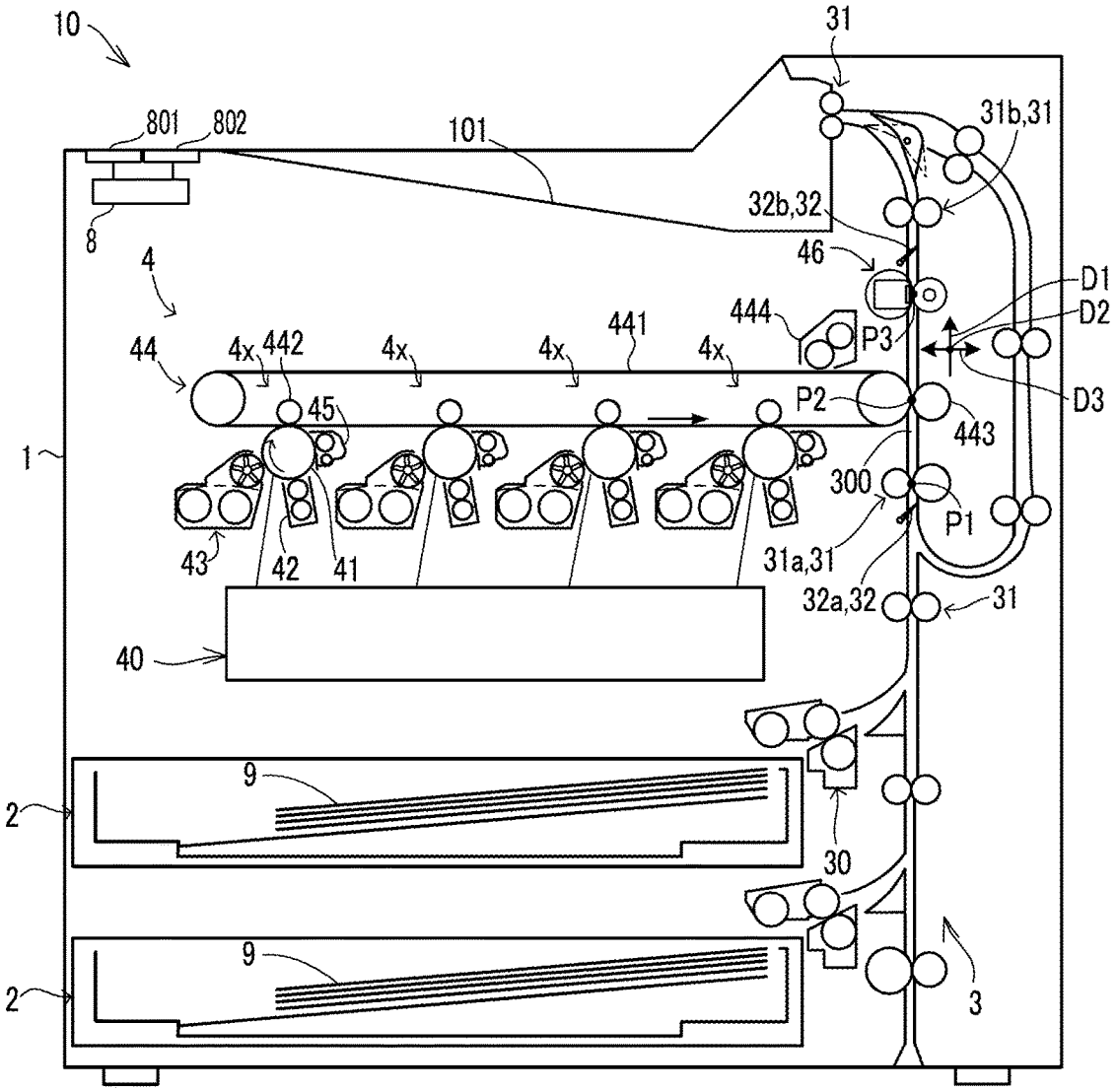
FIG. 1 is a configuration diagram of an image forming apparatus according to an embodiment.

As shown in FIG. 1, the image forming apparatus 10 includes a sheet conveying device 3 and printing device 4, a control device 8, an operation device 801, and a display device 802 that are provided in a main portion 1.

The printing device 4 includes one or more image forming device 4*x*, a laser scanning unit 40, a transfer device 44 and a fixing device 46. The image forming device 4*x* includes a drum-shaped photoconductor 41, a charging device 42, a developing device 43 and a drum cleaning device 45.

The operation device 801 is a device that receives human operation, and includes, for example, operation buttons and a touch panel. The display device 802 is a device that displays information, and includes, for example, a panel display device such as a liquid-crystal display unit or the like.

The sheet conveying device 3 includes a sheet feeding device 30 and a plurality of sets of conveying roller pairs 31. The sheet feeding device 30 feeds a sheet 9 that is stored in a sheet storing portion 2 to a conveyance path 300 in the main portion 1. The conveyance path 300 forms a passage for conveying the sheet 9.

The plurality of sets of conveying roller pairs 31 are rotationally driven by a motor (not shown), and by rotating with the sheet 9 therebetween, convey the sheet 9 along the conveyance path 300 and further outputs the sheet 9 to an output tray 101.

The sheet 9 passes through a registration position P1, a transfer position P2, and a fixing position P3 in the conveyance path 300, and is then outputted to the output tray 101.

In the description below, the direction in which the sheet 9 is conveyed along the conveyance path 300 is referred to as the sheet conveying direction D1. The registration position P1 is a position on an upstream side of the sheet conveying direction D1 with respect to the transfer position P2. The fixing position P3 is a position on a downstream side in the sheet conveying direction D1 with respect to the transfer position P2.

In addition, a direction along the conveyance path 300 that crosses the sheet conveying direction D1 is referred to as the width direction D2. In addition, a direction that crosses the sheet conveying direction D1 and the width direction D2 is referred to as the crossing direction D3. In the present embodiment, the width direction D2 is a direction that is orthogonal to the sheet conveying direction D1.

The plurality of sets of conveying roller pairs 31 includes a registration roller pair 31*a* and a post-fixing roller pair 31*b*.

The registration roller pair 31*a* is arranged at the registration position P1 in the conveyance path 300. The registration roller pair 31*a*, pauses the sheet 9 at the registration position P1, and then feeds the sheet 9 to the transfer position P2.

The post-fixing roller pair 31*b* is arranged at a position in the conveyance path 300 on the downstream side in the sheet conveying direction D1 with respect to the fixing position P3. The post-fixing roller pair 31*b* is an example of a mechanism that takes over conveyance of the sheet 9 from the fixing device 46.

The sheet conveying device 3 further includes a sheet detection portion 32 that detects the sheet 9 at a predetermined position in the conveyance path 300. In the present embodiment, the sheet detection portion 32 includes a first sheet detection portion 32*a* and a second sheet detection portion 32*b*.

The first sheet detection portion 32*a* detects the sheet 9 at a position in the conveyance path 300 on the upstream side in the sheet conveying direction D1 with respect to the registration position P1.

The registration roller pair 31*a* pauses after a predetermined amount of time has elapsed from when the sheet 9 was detected by the first sheet detection portion 32*a*, and then rotates again. Thus, the timing for feeding the sheet 9 to the transfer position P2 is adjusted.

The second sheet detection portion 32*b* detects the sheet 9 at a position between the fixing position P3 and the post-fixing roller pair 31*b* in the conveyance path 300.

The plurality of sets of conveying roller pairs 31 stop when a predetermined amount of time has elapsed after the last sheet 9 to be conveyed was detected by the second sheet detection portion 32*b*. The second sheet detection portion 32*b* is used for confirming that the sheet 9 has been outputted from the conveyance path 300.

For example, the first sheet detection portion 32*a* and the second sheet detection portion 32*b* each include a displacement member and a detection sensor (not shown).

The displacement member, by coming in contact with the sheet 9 that is conveyed along the conveyance path 300, is displaced to a retreat position away from a reference position. The detection sensor detects the displacement member that has been displaced to the retreat position.

The printing device 4 forms a toner image on the sheet 9 that is conveyed along the conveyance path 300 by the sheet conveying device 3. The toner image is a developer image that uses toner as a developer. The toner is an example of the developer in a granular form.

The image forming apparatus 10 shown in FIG. 1 is a tandem type color image forming apparatus. Therefore, the printing device 4 includes four image forming devices 4*x* that correspond to toner of the four colors yellow, cyan, magenta and black.

In each image forming devices 4*x*, a photoconductor 41 rotates and a charging device 42 electrically charges the surface of the photoconductor 41. Moreover, the laser scanning unit 40, by scanning a laser beam, writes an electrostatic latent image on the surface of the photoconductor 41.

Furthermore, a developing device 43, by supplying the toner to the surface of the photoconductor 41, develops the electrostatic latent image as the toner image. The photoconductor 41 is an example of an image-carrying member that rotates while carrying the toner image.

The transfer device 44 transfers the toner image to the sheet 9 at the transfer position P2 in the conveyance path 300. The transfer device 44 includes an intermediate transfer belt 441, four primary transfer devices 442 that correspond to the four image forming devices, a secondary transfer device 443, and a belt cleaning device 444.

In the transfer device 44, each primary transfer device 442 transfers the toner image on the surface of the photoconductor 41 to the surface of the intermediate transfer belt 441. Thus, a color toner image is formed on the surface of the intermediate transfer belt 441.

The secondary transfer device 443, in the conveyance path 300, transfers the toner image formed on the intermediate transfer belt 441 to the sheet 9.

Note that in a case where the image forming apparatus 10 is a monochrome image forming apparatus, the secondary transfer device 443, in the conveyance path 300, transfers the toner image on the photoconductor 41 to the sheet 9.

A drum cleaning device 45 removes waste toner that remains on the surface of the photoconductor 41. The belt cleaning device 444 removes the waste toner that remains on the intermediate transfer belt 441.

[Fixing Device 46]

The fixing device 46 heats and applies pressure to the toner image on the sheet 9 while conveying the sheet 9 at the fixing position P3 in the conveyance path 300. Thus, the fixing device 46 fixes the toner image on the sheet 9.

Figure 2:
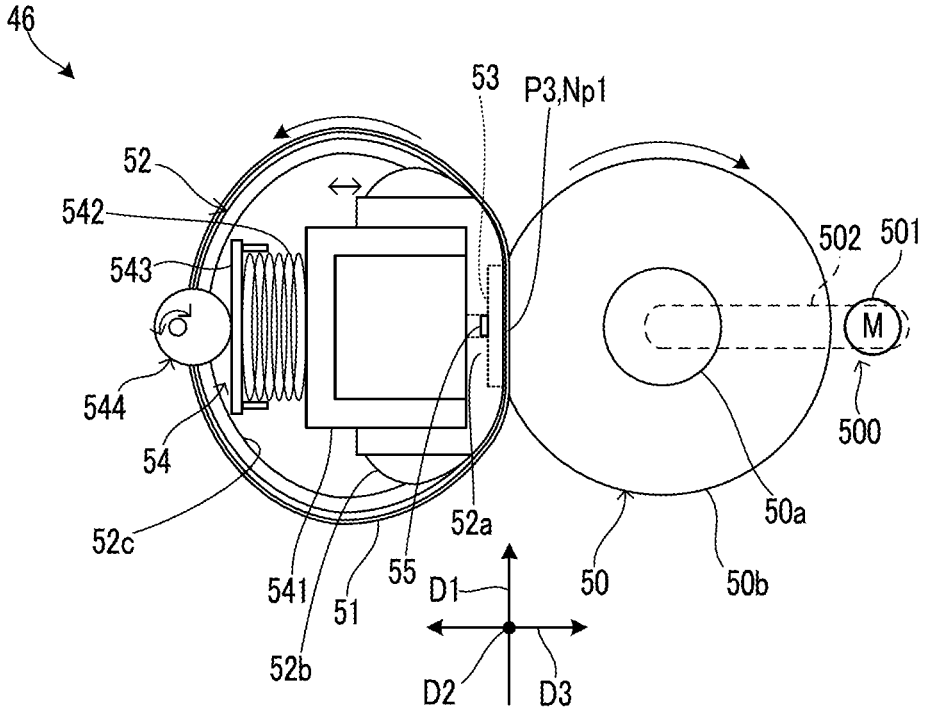
FIG. 2 is a configuration diagram of a fixing device in the image forming apparatus according to an embodiment.

As shown in FIG. 2, the fixing device 46 includes a pressure roller 50, a drive mechanism 500, a fixing member 51, a support member 52, a heater 53, a biasing mechanism 54, and a temperature sensor 55.

The fixing member 51 is a flexible cylindrical member. In other words, the fixing member 51 is a continuous belt-shaped flexible cylindrical body. For example, the fixing member 51 is a cylindrical film member.

The pressure roller 50 is arranged so as to face the fixing member 51 in the crossing direction D3. The pressure roller 50 is an example of a pressure member. The pressure roller 50 has a metal core portion 50*a* and an elastic outer layer 50*b*.

The metal core portion 50*a* is rotatably supported. The elastic outer layer 50*b* is formed around the metal core portion 50*a*. The elastic outer layer 50*b* is a layer made of an elastic member such as rubber or the like. The elastic outer layer 50*b*, by being pressed against the fixing member 51, forms a nip Np1 between the elastic outer layer 50*b* and the fixing member 51.

The support member 52 rotatably supports the fixing member 51 and is displaceable along the crossing direction D3. The support member 52 has an opposing portion 52*a* that comes in contact with an inner surface of the fixing member 51 and faces the pressure roller 50 via the fixing member 51.

The heater 53 is assembled in the opposing portion 52*a*. The pressure roller 50, the fixing member 51, and the support member 52 are formed so as to extend in the width direction D2. For example, the heater 53 is configured by a plurality of heating elements arranged along the width direction D2. Each heating element generates heat when supplied with electric power.

The heater 53 comes in contact with an inner surface of the fixing member 51. Thus, the heater 53 heats a portion of the fixing member 51 that forms the nip Np1.

The temperature sensor 55 measures a temperature of the heater 53. For example, the temperature sensor 55 is a thermistor.

The temperature detected by the temperature sensor 55 is used in fixing-temperature control. The fixing-temperature control is a feedback control for controlling electric power supplied to the heater 53 by comparing the temperature of the heater 53 with a preset target temperature.

The temperature sensor 55 measures a temperature that will be an alternate index of the temperature at the portion where the nip Np1 is formed in the fixing member 51. Therefore, the temperature sensor 55 may be arranged at a position for measuring the temperature of the fixing member 51.

The fixing member 51 is heated by the heater 53, and rotatably supported by the support member 52. Furthermore, the fixing member 51 is supported by the support member 52 so as to be displaceable in the crossing direction D3.

The drive mechanism 500 includes a motor 501, and a gear mechanism 502 that transmits the rotational force of the motor 501 to the pressure roller 50. The motor 501 is a driving source that rotationally drives the pressure roller 50.

The pressure roller 50, by being rotationally driven by the motor 501, rotationally drives the fixing member 51. By the fixing member 51 being rotationally driven, an inner-side surface of the fixing member 51 slides with respect to the heater 53 and the opposing portion 52*a*.

The support member 52 has a plurality of ribs 52*b* for reducing frictional resistance with the fixing member 51. The plurality of ribs 52*b* are arranged at intervals in the width direction D2. Each of the ribs 52*b* is formed so as to extend along the direction of rotation of the fixing member 51. A lubricant is applied to the inner surface of the fixing member 51.

Furthermore, the support member 52 has a pair of edge-guiding portions 52*c*. The pair of edge-guiding portions 52*c* guide, along a predetermined curved path, both end portions of the fixing member 51 opposite in the width direction D2.

For example, the support member 52 is a member that is a combination of one member that includes the opposing portion 52*a* and two members each of which includes one of the pair of edge-guiding portions 52*c*.

The biasing mechanism 54 elastically biases the fixing member 51 toward the pressure roller 50 along the crossing direction D3. In the present embodiment, the biasing mechanism 54, by elastically biasing the support member 52 toward the pressure roller 50 along the crossing direction D3, biases the fixing member 51 toward the pressure roller 50. The biasing mechanism 54 includes a pressing member 541, a spring 542, a spring holding member 543, and a bias-force adjusting mechanism 544.

The spring holding member 543 holds one end of the spring 542. The spring 542 elastically biases the support member 52 toward the pressure roller 50 via the pressing member 541. The pressing member 541 receives the elastic force of the spring 542 and biases the support member 52 toward the pressure roller 50. In addition, the pressing member 541 also plays a role of reinforcing the support member 52.

The bias-force adjusting mechanism 544 is a mechanism capable of changing the bias force by which the biasing mechanism 54 biases the fixing member 51 toward the pressure roller 50. For example, the bias-force adjusting mechanism 544 is a cam mechanism that displaces the spring holding member 543 along the crossing direction D3.

The cam mechanism displaces the spring holding member 543 in a direction toward the pressure roller 50, by which the bias force increases. On the other hand, the cam mechanism displaces the spring holding member 543 in a direction away from the pressure roller 50, by which the bias force decreases.

[Control Device 8]

The control device 8 executes various types of data processing, and executes control of devices such as the sheet conveying device 3, the printing device 4, the display device 802, and the like. The object of control by the control device 8 includes the fixing device 46.

Figure 3:
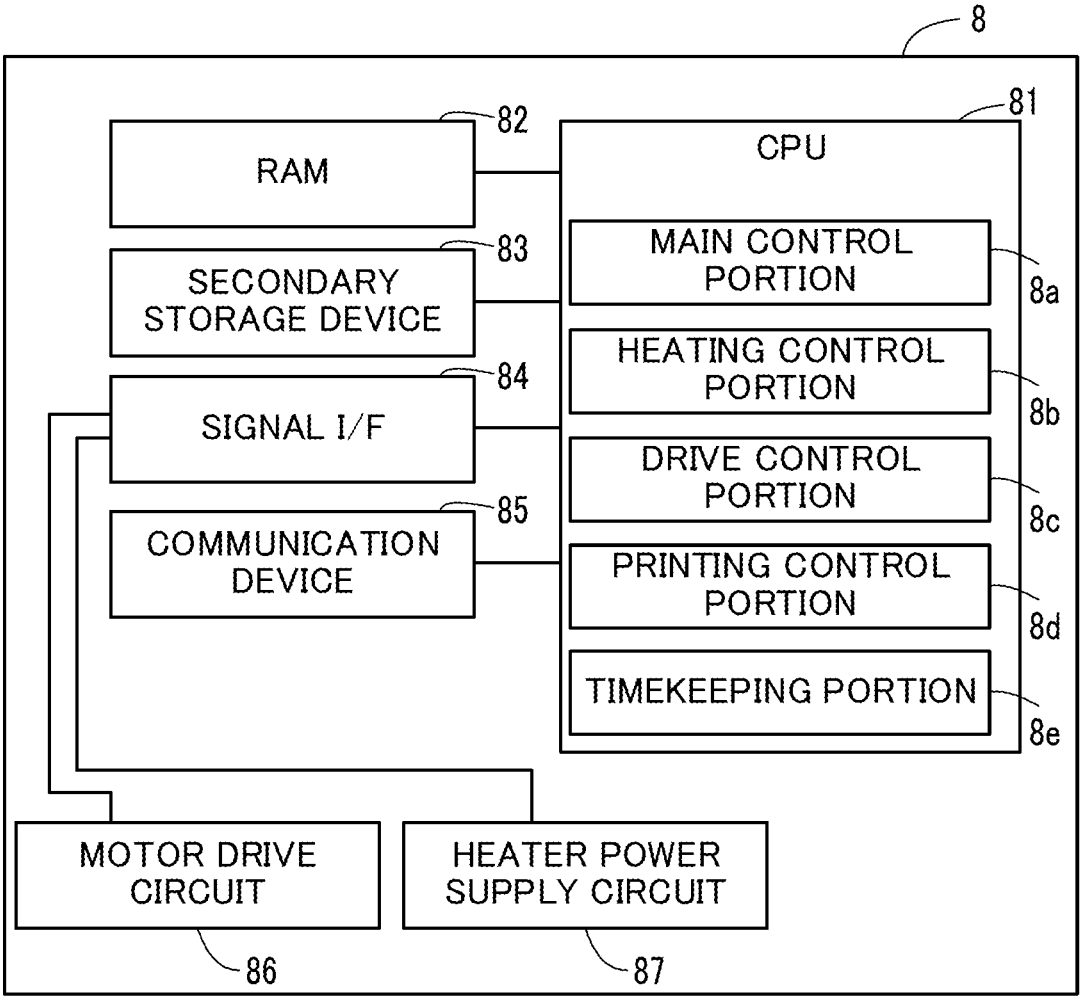
FIG. 3 is a block diagram showing a configuration of a control device in the image forming apparatus according to an embodiment.

As shown in FIG. 3, the control device 8 includes a central processing unit (CPU) 81, and peripheral devices such as a random access memory (RAM) 82, a secondary storage device 83, a signal interface 84, and the like.

Furthermore, the control device 8 includes a communication device 85, a motor drive circuit 86 and a heater power supply circuit 87.

The CPU 81 is a processor that, by executing a computer program, executes various types of data processing and control. The RAM 82 is a computer-readable, volatile storage device. The RAM 82 primarily stores the computer program that is executed by the CPU 81, and data that the CPU 81 outputs and references in the process of executing various types of processing.

The CPU 81 includes a plurality of processing modules that are achieved by executing the computer program. The plurality of processing modules include a main control portion 8*a*, a heating control portion 8*b*, drive control portion 8*c*, a printing control portion 8*d*, and the like.

The main control portion 8*a* executes control such as start control that starts various types of processing according to operation performed on the operation device 801, control of the display device 802, and the like.

The heating control portion 8*b* executes the fixing-temperature control to control the amount of electric power supplied to the heater 53 of a heating device 5. The heating control portion 8*b*, by controlling the heater power supply circuit 87, adjusts the amount of electric power supplied to the heating device 5.

The heater power supply circuit 87 supplies electric power to the heater 53 according to a power-supply instruction from the heating control portion 8*b*. For example, in a case where the power-supply instruction indicates how much to increase or decrease the amount of electric power supplied to the heater 53, the heater power supply circuit 87 adjusts the amount of electric power supplied to the heater 53 according to the power-supply instruction.

The drive control portion 8*c* controls the sheet conveying device 3, the drive mechanism 500, the bias-force adjusting mechanism 544, and the like.

The motor drive circuit 86 supplies electric power to the motor 501 of the drive mechanism 500 according to a speed instruction from the drive control portion 8*c*. Thus, the motor 501 rotates at a speed according to the speed instruction. For example, the motor drive circuit 86 is an inverter drive circuit.

The printing control portion 8*d*, in synchronization with the conveyance of the sheet 9 by the sheet conveying device 3, causes the printing device 4 to execute the printing process.

The secondary storage device 83 is a computer-readable non-volatile storage device. The secondary storage device 83 is capable of storing and updating the computer program and various types of data. One or both of a flash memory or a hard disk drive can, for example, be used as the secondary storage device 83.

The signal interface 84 converts signals outputted by various types of sensors such as the temperature sensor 55 and the like to digital data, and transfers the converted digital data to the CPU 81. Furthermore, the signal interface 84 converts control instructions outputted by the CPU 81 to control signals and transfers the control signals to devices to be controlled.

The communication device 85 executes communication with other devices such as a host device and the like that send printing jobs to the image forming apparatus 10. The CPU 81 communicates with the other devices via the communication device 85.

Incidentally, the volume of the elastic outer layer 50*b* of the pressure roller 50 changes depending on the heat received from the heater 53.

In the fixing device 46, the peripheral speed of the fixing member 51 and the pressure roller 50 at the nip Np1 changes according to the extent of thermal expansion of the elastic outer layer 50*b* of the pressure roller 50. As a result, the conveying speed at which the sheet 9 is conveyed by the fixing device 46 changes.

In a case where the conveying speed at which the sheet 9 is conveyed by the fixing device 46 is too fast, the sheet 9 does not bend at a position in front of the fixing position P3. In addition, in a case where the conveying speed at which the sheet 9 is conveyed by the fixing device 46 is too slow, the sheet 9 may not bend noticeably at a position in front of the fixing position P3 due to the stiffness of the sheet 9.

In other words, it is difficult to maintain a suitable conveying speed at which the sheet 9 is conveyed by the fixing device 46 by adjusting the rotational speed of the pressure roller 50 in the fixing device 46 according to the detection result of the bending of the sheet 9.

On the other hand, the drive control portion 8*c* of the image forming apparatus 10 executes fixing drive control as will be described later. Thus, it is possible to adequately maintain the conveying speed at which the sheet 9 is conveyed by the fixing device 46. In the following, the fixing drive control will be described.

The plurality of processing modules in the CPU 81 includes a timekeeping portion 8*e* (refer to FIG. 3). The drive control portion 8*c* and the timekeeping portion 8*e* execute the fixing drive control. In the following description, the conveying speed at which the sheet 9 is conveyed by the fixing device 46 is referred to as the fixing conveying speed.

[Fixing Drive Control]

The timekeeping portion 8*e* executes a timekeeping process as a part of the fixing drive control for every printing process that is executed for one sheet 9 The timekeeping process is a process of timing the time required for detection results of the sheet detection portion 32 to show a predetermined change.

More specifically, the timekeeping portion 8*e*, in the timekeeping process, detects a first point in time and a second point in time, and times a trailing-edge passage time TR1, which is the amount of time from the first point in time to the second point in time. The trailing-edge passage time TR1 is an example of a timekeeping time of the timekeeping portion 8*e*.

The first point in time is a point in time when the first sheet detection portion 32*a* changes from a state of detecting the sheet 9 to a state of not detecting the sheet 9. The second point in time is a point in time when the second sheet detection portion 32*b* changes from a state of detecting the sheet 9 to a state of not detecting the sheet 9.

The first point in time is a point in time when the trailing edge of the sheet 9 passes a position of the first sheet detection portion 32*a*. The second point in time is a point in time when the trailing edge of the sheet 9 passes a position of the second sheet detection portion 32*b*.

The slower the conveying speed at which the sheet 9 is conveyed by the fixing device 46 is, the longer the trailing-edge passage time TR1 becomes. In other words, the trailing-edge passage time TR1 has a negative correlation with respect to the conveying speed at which the sheet 9 is conveyed by the fixing device 46.

In addition, the drive control portion 8*c*, as a part of the fixing drive control, executes fixing conveying control for controlling the motor drive circuit 86 according to the trailing-edge passage time TR1. The drive control portion 8*c* and the motor drive circuit 86 are an example of a speed control portion for controlling the rotational speed of the motor 500 according to the timekeeping time of the timekeeping portion 8*e*.

Here, the current rotational speed of the motor 501 is taken to be V1, and a preset reference time is taken to be TS1. The reference time TS1 is the trailing-edge passage time TR1 when the fixing device 46 conveys the sheet 9 at an ideal speed corresponding to the conveying speed at which the sheet 9 is conveyed by the sheet conveying device 3.

For example, the drive control portion 8*c* sets a rotational speed V2 of the motor 501 after adjustment by applying the trailing-edge passage time TR1 in Equation (1) below. Note that k1 in Equation (1) is a predetermined positive coefficient. For example, k1 is 1.

$$V2 = k1 \cdot V1 \cdot \frac{TR1}{TS1} \quad (1)$$

The drive control portion 8 controls the motor drive circuit 86 to rotate the motor 501 at the rotational speed V2 every time the trailing-edge passage time TR1 is timed. Thus, when the printing process is executed for the next one sheet 9, the rotational speed of the motor 501 of the fixing device 46 is adjusted to the rotational speed V2.

For example, it is possible for the reference time TS1 to be a constant. In addition, the timekeeping portion 8*e* may time a leading-edge passage time TF1 in the timekeeping process, and the drive control portion 8*c* may derive the reference time TS1 from the leading-edge passage time TF1.

The leading-edge passage time TF1 is the amount of time from a third point in time to a fourth point in time. The third point in time is a point in time where the first sheet detection portion 32*a* changes from a state of not detecting the sheet 9 to a state of detecting the sheet 9. The fourth point in time is a point in time when the second sheet detection portion 32*b* changes from a state of not detecting the sheet 9 to a state of detecting the sheet 9.

The third point in time is a point in time when the trailing edge of the sheet 9 passes a position of the first sheet detection portion 32*a*. The fourth point in time is a point in time when the leading edge of the sheet 9 passes a position of the second sheet detection portion 32*b*.

The slower the conveying speed at which the sheet 9 is conveyed by the sheet conveying device 3 is, the longer the leading-edge passage time TF1 becomes. In other words, the leading-edge passage time TR1 has a negative correlation with respect to the conveying speed at which the sheet 9 is conveyed by the fixing device 46.

For example, the drive control portion 8*c* derives the reference time TS1 by applying the leading-edge passage time TF1 in Equation (2) below. In Equation (2), k2 is a predetermined positive coefficient. For example, k2 is 1.

$$TS1 = k2 \cdot TF1 \quad (2)$$

The drive control portion 8*c* may set the rotational speed V2 of the motor 501 after adjustment by applying the current trailing-edge passage time TR1 and the previous trailing-edge passage time TR2 to Equation (3) below. Note that in Equation (3), k3 is a predetermined positive coefficient. For example, k3 is 1.

$$V2 = V1 \cdot \left(1 - k3 \cdot \frac{TR2}{TR1}\right) \quad (3)$$

Equation (3) represents setting the rotational speed V2 of the motor 501 after adjustment according to the reciprocal of the rate of change of the trailing-edge passage time TR1.

The actual conveying speed at which the sheet 9 is conveyed by the fixing device 46 is reflected on the leading-edge passage time TF1. By executing the fixing drive control, the conveying speed at which the sheet 9 is conveyed by the fixing device 46 is suitably maintained.

In addition, in a case where the elastic outer layer 50*b* of the pressure roller 50 thermally expands due to heat received from the heater 53, the length of the nip Np1 in the sheet conveying direction D1 tends to become long. In other words, in a case where the elastic outer layer 50*b* thermally expands, the surface area of the nip Np1 tends to increase.

When the surface area of the nip Np1 increases, the amount of heat transferred from the fixing member 51 to the toner image on the sheet 9 increases even though the temperature of the fixing member 51 does not change. When the amount of heat transferred from the fixing member 51 to the toner image increases, it becomes easy for the sheet 9 to adhere to the fixing member 51.

An excessive or insufficient amount of heat transferred from the fixing member 51 to the toner image will likely cause distortion of the toner image on the sheet 9.

Therefore, the drive control portion 8*c* may also control the bias-force adjusting mechanism 544 according to the trailing-edge passage time TR1. The drive control portion 8*c* controlling the bias-force adjusting mechanism 544 is an example of a bias control portion.

More specifically, the drive control portion 8*c* controls the bias-force adjusting mechanism 544 so that the shorter the trailing-edge passage time TR1 is than the reference time TS1, the more the biasing mechanism 54 reduces the bias force biasing the fixing member 51 toward the pressure roller 50.

On the other hand, the drive control portion 8*c* controls the bias-force adjusting mechanism 544 so that the longer the trailing-edge passage time TR1 is than the reference time TS1, the more the biasing mechanism 54 increases the bias force.

By the bias-force adjusting mechanism 544 being controlled, it is possible to avoid the occurrence of trouble such as the sheet 9 adhering to the fixing member 51, the distortion of the toner image, or the like.

In addition, instead of the drive control portion 8*c* controlling the bias-force adjusting mechanism 544, the heating control portion 8*b* can control the electric power supplied to the heater 53 according to the trailing-edge passage time TR1.

For example, the shorter the trailing-edge passage time TR1 is than the reference time TS1, the heating control portion 8*b* lowers the target temperature in the fixing-temperature control. Thus, the amount of electric power supplied to the heater 53 is reduced.

On the other hand, the longer the trailing-edge passage time TR1 is than the reference time TS1, the drive control portion 8*c* raises the target temperature in the fixing-temperature control. Thus, the amount of electric power supplied to the heater 53 is increased.

By correcting the target temperature, it is possible to avoid the occurrence of trouble such as the sheet 9 adhering to the fixing member 51, the distortion of the toner image, or the like.

[First Application Example]

In the following, a first application example of the image forming apparatus 10 will be described.

In the present application example, the timekeeping portion 8*e* times a single-point passage time instead of the trailing-edge passage time TR1.

The single-point passage time is a time during which the second sheet detection portion 32*b* continues detecting the sheet 9. In other words, the single-point passage time is a time from a point in time at which the second sheet detection portion 32*b* changes from a state of not detecting the sheet 9 to a state of detecting the sheet 9 to a point in time at which the second sheet detection portion 32*b* changes again to a state of not detecting the sheet 9.

The single-point passage time, similar to the trailing-edge passage time TR1, is also negatively correlated to the conveying speed at which the sheet 9 is conveyed by the fixing device 46.

For example, the drive control portion 8*c* in the present application example sets the rotational speed V2 of the motor 501 after adjustment by applying a single-point passage time to an Equation in which the trailing-edge passage time TR1 in Equation (1) described above is substituted for the single-point passage time.

In the present application example, the reference time TS1 is considered to be a constant. In addition, the timekeeping portion 8*e* may time the registration position passage time in the timekeeping process, and the drive control portion 8*c* may derive the reference time TS1 from the registration position passage time.

The registration position passage time is a time obtained by adding a predetermined amount of time to an amount of time from a point in time at which the registration roller pair 31*a* starts rotating again after being paused to a point in time at which the first sheet detection portion 32*a* changes from a state of detecting the sheet 9 to a state of not detecting the sheet 9.

For example, the drive control portion 8*c* derives the reference time TS1 by applying the registration position passage time to an Equation in which the leading-edge passage time TF1 in Equation (2) described above is substituted for the registration position passage time.

In a case of applying the present application example as well, the same effect as that when the image forming apparatus 10 is applied is obtained.

[Second Application Example]

In the following, a second application example of the image forming apparatus 10 will be described.

In the present application example, the second sheet detection portion 32*b* detects the sheet 9 at a position between the secondary transfer device 443 and the fixing position P3 in the conveyance path 300. The secondary transfer device 443 is an example of a mechanism that feeds the sheet 9 to the fixing position P3.

In the present application example, the timekeeping portion 8*e* and the drive control portion 8*c* execute the same processes as in the embodiment. In a case of applying the present application example as well, the same effect as that when the image forming apparatus 10 is applied is obtained.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus, comprising:

a transfer device configured to transfer a developer image to a sheet at a transfer position in a conveyance path while conveying the sheet;

a registration roller pair configured to pause the sheet at a registration position in the conveyance path, and then feed the sheet to the transfer position;

a fixing device configured to fix the developer image to the sheet by heating and applying pressure to the developer image on the sheet at a fixing position in the conveyance path while conveying the sheet;

a sheet detection portion configured to detect the sheet at a predetermined position in the conveyance path; and a control device configured to control the fixing device;

wherein the fixing device includes:

a heater;

a fixing member configured to be heated by the heater and supported so as to be able to rotate and so as to be displaceable in a crossing direction that crosses a sheet conveying direction;

a pressure member arranged facing the fixing member in the crossing direction and comprising an elastic outer layer that comes in pressure contact with the fixing member, and configured to rotationally drive the fixing member by being rotationally driven;

a motor configured to rotationally drive the pressure member; and a biasing mechanism configured to elastically bias the fixing member toward the pressure member along the crossing direction;

the sheet detection portion is configured to detect the sheet at a first position and a second position; wherein the first position is a position between a mechanism that feeds the sheet to the fixing position and the fixing position in the conveyance path;

the second position is a position between the fixing position and a mechanism that takes over conveyance of the sheet from the fixing device;

the control device includes:

a timekeeping portion configured to time a time required for detection results from the sheet detection portion to show a predetermined change; and a speed control portion configured to control a rotational speed of the motor according to the time timed by the timekeeping portion;

the sheet detection portion includes:

a first sheet detection portion configured to detect the sheet at a position on an upstream side in the sheet conveying direction with respect to the registration position in the conveyance path; and a second sheet detection portion configured to detect the sheet at a position between the fixing position and a mechanism that takes over conveyance of the sheet from the fixing device; and the timekeeping portion times a time from a first point in time when the first sheet detection portion changes from a state of detecting the sheet to a state of not detecting the sheet to a second point in time when the second sheet detection portion changes from a state of detecting the sheet to a state of not detecting the sheet.

2. The image forming apparatus according to claim 1, wherein the biasing mechanism includes a bias-force adjusting mechanism configured to change a bias force that biases the fixing member toward the pressure member; and the control device further includes a bias control portion configured to control the bias-force adjusting mechanism according to a time timed by the timekeeping portion.

3. The image forming apparatus according to claim 1, wherein the control device further includes a heating control portion configured to control electric power supply to the heater according to time timed by the timekeeping portion.

4. The image forming apparatus according to claim 1, wherein the fixing member is a flexible cylindrical member;

the fixing device includes a support member with an opposing portion that comes in contact with a surface on an inner side of the fixing member and that faces the pressure member via the fixing member, the support member rotatably supporting the fixing member and configured to be displaceable in the crossing direction; and the biasing mechanism biases the fixing member toward the pressure member by elastically biasing the support member toward the pressure member along the crossing direction.

* * * * *